US006827676B2

(12) United States Patent
Kuo

(10) Patent No.: US 6,827,676 B2
(45) Date of Patent: Dec. 7, 2004

(54) MULTIFUNCTIONAL PHYSICAL TRAINING MACHINE

(76) Inventor: Johnson Kuo, 11F-1C, No. 342, Keelung Rd., Sec. 1, Taipei (TW)

( * ) Notice: Subject to any disclaimer, the term of this patent is extended or adjusted under 35 U.S.C. 154(b) by 134 days.

(21) Appl. No.: 10/196,239

(22) Filed: Jul. 17, 2002

(65) Prior Publication Data

US 2003/0224913 A1 Dec. 4, 2003

(30) Foreign Application Priority Data

May 29, 2002 (TW) ..... 91207832 U

(51) Int. Cl.[7] ..... A63B 26/00

(52) U.S. Cl. ..... 482/144; 482/148; 482/121; 482/122; 482/129; 482/130; 482/907

(58) Field of Search ..... 482/121–133, 482/142–145, 148, 907, 908, 95–97, 51, 115, 57, 52, 56, 83, 138, 904, 135; 601/24

(56) References Cited

U.S. PATENT DOCUMENTS 5,722,918 A * 3/1998 Lee ..... 482/72
D396,509 S * 7/1998 Sands et al. ..... D21/191
5,813,954 A * 9/1998 Wilkinson ..... 482/124
6,152,866 A * 11/2000 Kuo ..... 482/142
6,634,996 B2 * 10/2003 Jacobsen ..... 482/96
6,692,412 B2 * 2/2004 Chen et al. ..... 482/96

* cited by examiner

*Primary Examiner*—Nicholas D. Lucchesi
*Assistant Examiner*—L Amerson
(74) *Attorney, Agent, or Firm*—Bacon & Thomas

(57) ABSTRACT

A multifunctional physical training machine. The training machine includes a frame, two first pad members, a second pad member and a cord assembly. The frame includes a first base bar and a second base bar for resting on the ground, a first frame bar having an end thereof fixed with the first base bar and a second frame bar having an end thereof fixed with the second base bar and the other end thereof connected to the first frame bar. The first and the second pad members are disposed on the first frame bar in different elevation. The cord assembly has two elastic cords detachably connected to the first base bar or the second base bar, and two holding members disposed at the ends of the elastic cords respectively. The cord assembly further has two length adjusting devices to change the lengths of the elastic cords.

9 Claims, 10 Drawing Sheets

MULTIFUNCTIONAL PHYSICAL TRAINING MACHINE

FIELD OF THE INVENTION

The present invention relates generally to a physical training machine, and more particularly to a multifunctional physical training machine.

BACKGROUND OF THE INVENTION

In modern life, people pay more attention to health and body building. Some people go to gymnasium for physical training and some people like to take exercise at home. In exercise, people will sweat to get up their metabolism quickly, and more particularly, this will cause weight reduction. A multifunctional training machine is brought to users, which has less size but has various exercise modes, for facilitating users to take exercise at home.

FIG. 1 shows a conventional multifunctional training machine 90, which is constructed of a first base bar 91, a first bar frame 92, a pad 93, a T bar 94, a second base bar 95, a second bar frame 92, a third bar frame 97 an a seat member 98. The first bar frame 92 has an inclined bar 921 having an end thereof fixed with the first base bar 91 and a handle 922 fixed to the inclined bar 921 at where it is closest to the distal end thereof. The pad 93 is fixed with the inclined bar 921 at the side thereof opposite from the pad 922. The T bar 94 is pivoted on the inclined bar 921 closing to the first base bar 91. The second bar frame 96 has an end thereof fixed with the inclined bar 921 at where under the handle 922 and the other end thereof fixed to the second base bar 95. The seat member 98 has an end thereof pivoted on the second bar frame 96 and the other end thereof supported by the third bar frame 97.

If a user takes exercise on the conventional training machine 90, please refer to FIG. 2, he/she may rest his/her abdomen against the pad 93 and rest his/her legs against the T bar 94, such that he/she can flex and extend the trunk to train the back muscles. The second exercise mode of the training machine 90 is that the user holds the handle 922 by both hands to do push-ups. The third exercise mode, which is similar to the first exercise mode, is that the user rests his/her back against the pad 93 to flex and extend the trunk to train the abdominal muscles. The user also can lie on the seat member to do sit-ups.

There are at least two points of the conventional training machine 90 to be improved:

1. The conventional training machine 90 only has function to train abdominal muscles and back muscles, it is hard to train the other muscles.
2. User will get boring after taking exercise on the conventional training machine 90, because of it only having fewer modes to take exercise thereon.

SUMMARY OF THE INVENTION

The primary objective of the invention is to provide a multifunctional physical training machine, which has a capacity of training the muscles of various portions of body with a variety of exercise modes.

According to the objective of the invention, a multifunctional physical training machine comprises a frame. At least one first pad member is disposed on the frame adjacent to a top side of the frame. At least one second pad member is disposed on the frame below the first pad member. At least one cord assembly has two elastic cords and two holding members, wherein the elastic cords have ends connected to a front side or a rear side of the frame respectively and the holding members are disposed at the other ends of the elastic cords respectively.

DETAIL DESCRIPTION OF THE INVENTION

Figure 1:
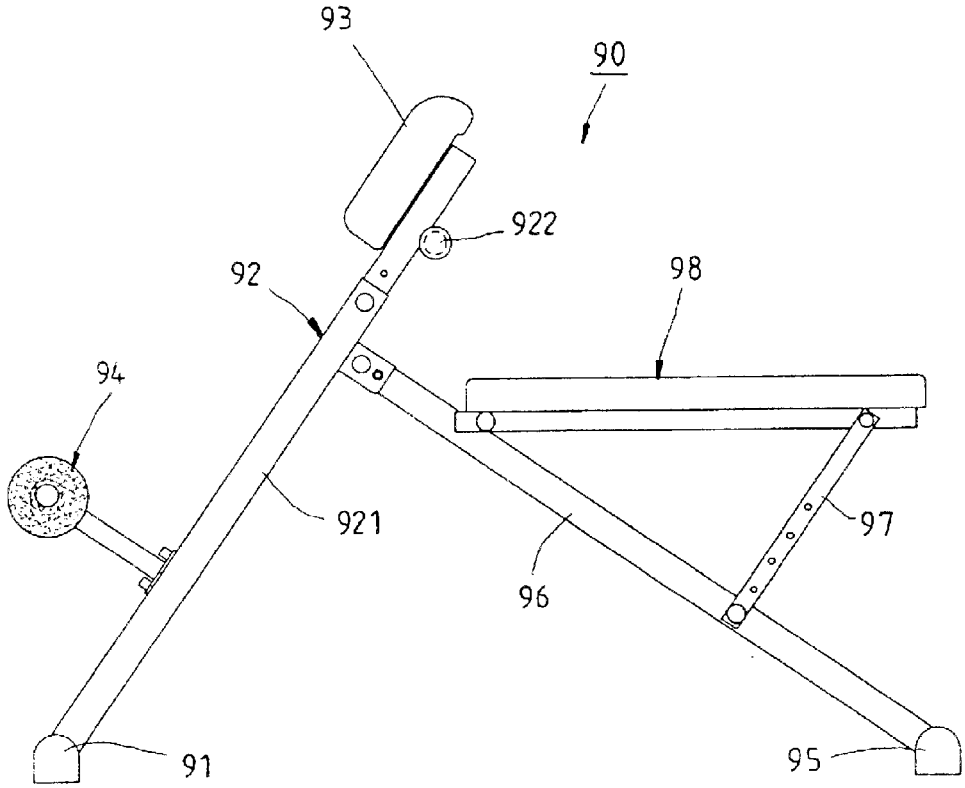
FIG.1 PRIOR ART
FIG. 1 shows a front view of a conventional multifunctional training machine.
Figure 2:
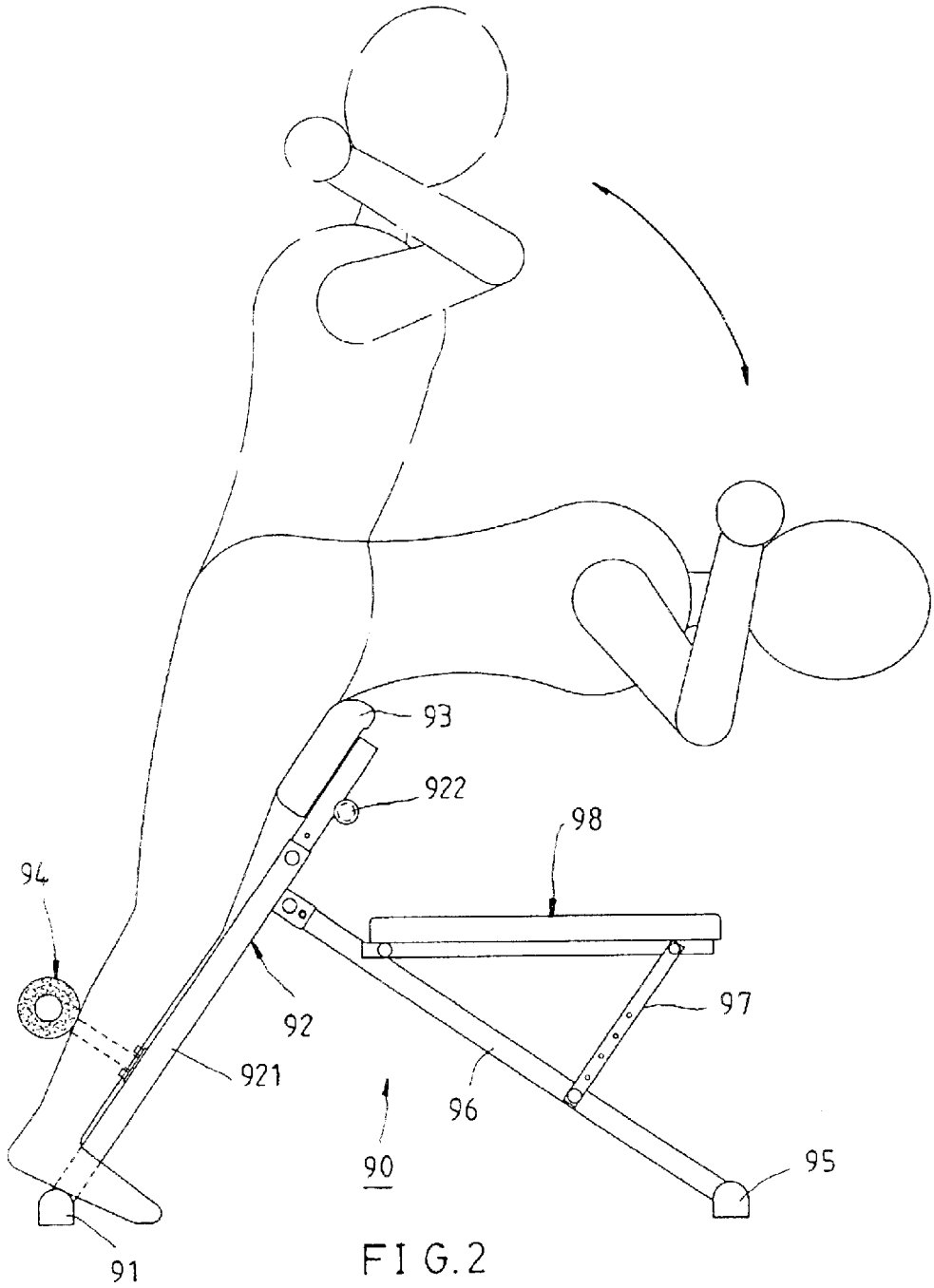
FIG.2 PRIOR ART
FIG. 2 shows how a user taking exercise on the conventional multifunctional training machine.
Figure 3:
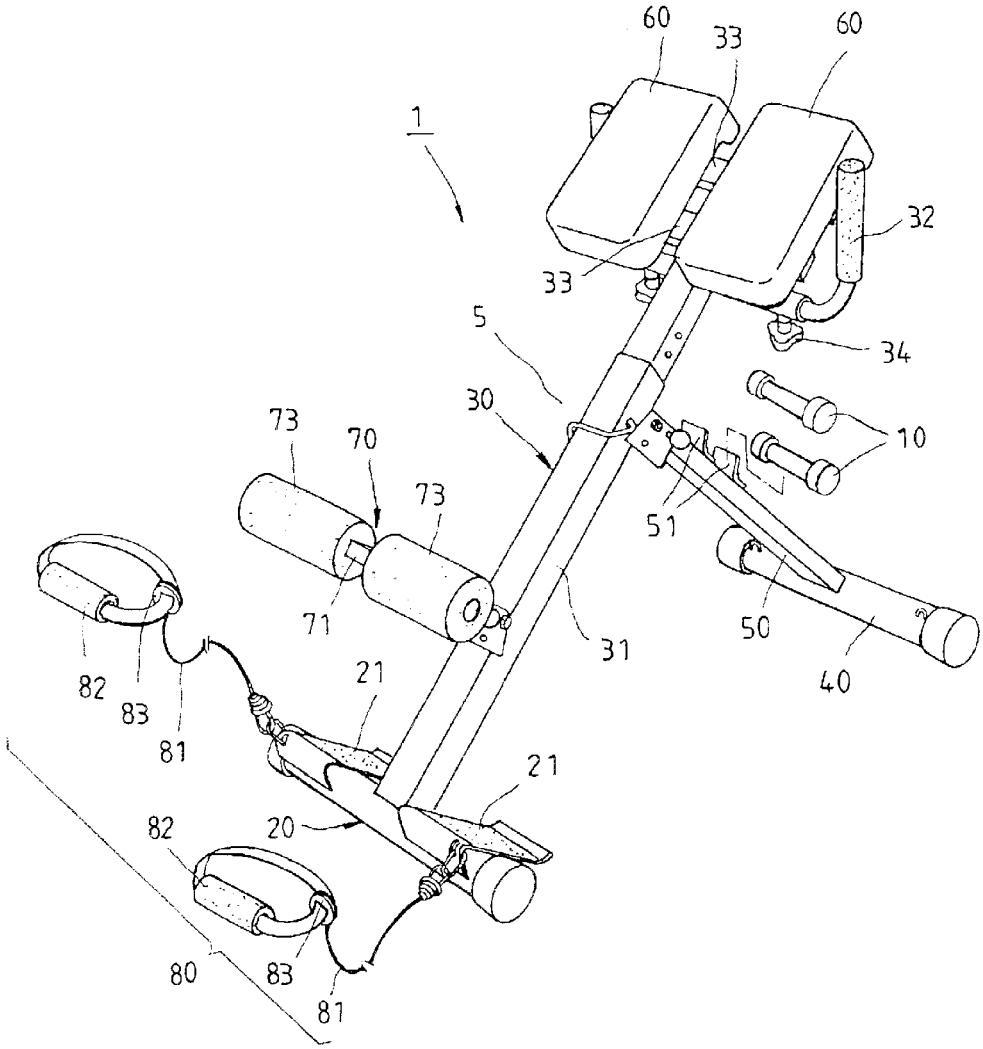
FIG. 3 shows a perspective view of a preferred embodiment of the present invention.

Please refer to FIG. 3, a multifunctional physical training machine 1 provided by a preferred embodiment of the present invention comprises a frame 5, two first pad members 60, a second pad member 70 and a cord assembly 80.

The frame 5 has a first base bar 20, a first frame bar 30, a second base bar 40 and a second frame bar 50. The first base bar 20 and the second base bar 40 are to rest on the ground, wherein the first base bar 20 is provided with two footrest portions 21. The first frame bar 30 has an inclined bar 31, a U-shaped handle 32 and two fixing bars 33. The inclined bar 31 has an end thereof fixed to the mid-section of the first base bar 20. It has to note that the inclined bar 31 of the first frame bar 30 can be a retractable bar assembly. The handle 32 has the mid-section thereof pivoted on the inclined bar 31 closing to the distal end thereof. The handle 32 can be turned and can be fixed at specific positions by means of two bolts 34. The fixing bars 33 are fixed the midsections thereof to the inclined bar 31 closing to the distal end thereof and at the side opposite from the handle 32. The first pad members 60 are fixed on the fixing bars 33. it is to be noted that the first pad members 60 can be replaced with a pad member of larger size.

The second frame bar 50 has an end thereof fixed at the mid-section of the second base bar 40 and the other end thereof pivoted on the first frame bar 30, such that the frame 5 can stand on the ground stably and can adjust the included angle between the first and the second frame bars 30 and 50. It has to note that if a manufacturer fixed the second frame bar 50 to the first frame bar 30 will be alright in the present invention and it is still included in the scope of the present invention. The second frame bar 50 is provided with two carrying devices 51 to put two dumbbells 10 thereon respectively. The numbers of the carrying devices 51 provided on the second frame bar 50 will be the choice of manufacturers.

Figure 6:
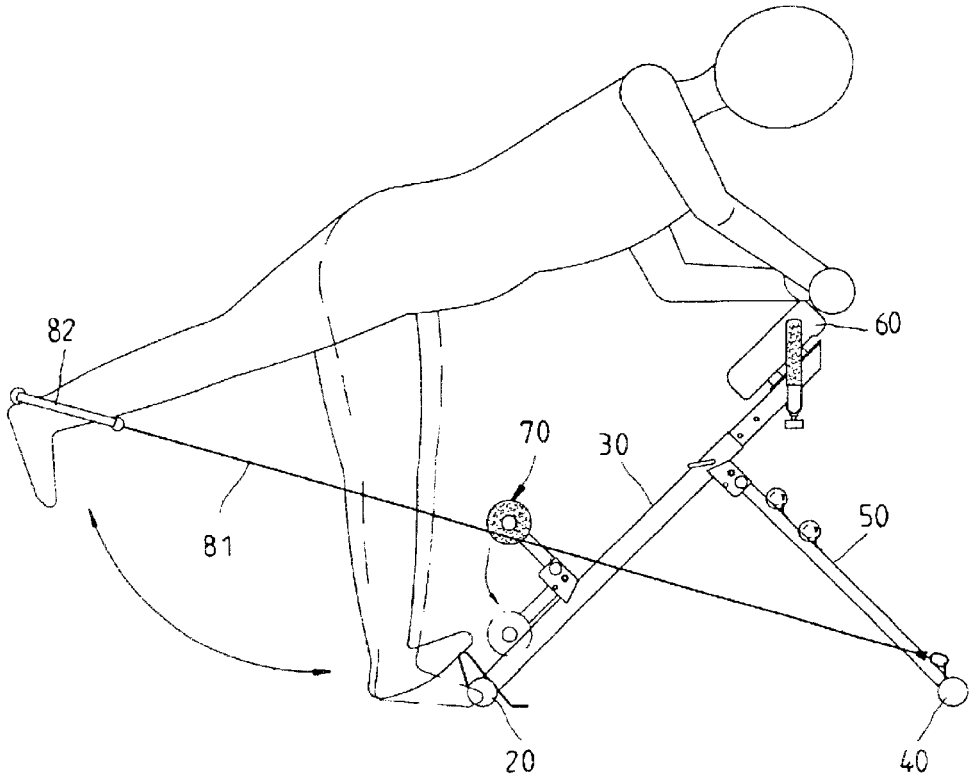

The second pad member 70 has a resting bar 71 and a coupling bar 72 (see FIG. 4), wherein the resting bar 71 is provided with two soft pads 73 thereon and the coupling bar 72 has an end thereof fixed to the resting bar 71 at mid-section thereof and the other end thereof pivoted on the first frame bar 30 at where closes to the base bar 20. The second pad member 70 can be turned to a position of perpendicular to the first frame bar 30 and to a position of the soft pads 73 resting against the first frame bar 30 as shown in FIG. 6. (Note: the second pad member 70 also can be fixed to the first frame bar 30, and sometime user has to sit on the second pad member 70, so the shape of the second pad member 70 is not limited in T-shape only.)

The cord assembly 80 has two elastic cords 81, two holding members 82 and two length adjusting devices 83.

The length adjusting device 83 is disposed at an end of the elastic cord 81 to change the length of the elastic cord 81 and the holding members 82 is secured with the length adjusting device 83 for user can control the elastic cord 81. The free ends of the elastic cords 81 are detachably secured on the first base bar 20 or on the second base bar 40 according to what kind of the exercise user may take. The length adjusting device 83 is the conventional device, so the detailed description is not necessary. The way of how to detachably secure the elastic cords 81 to the first base bar 20 or the second base bar 40 in the present invention is to provide ring devices on the first base bar 20 and the second base bar 40 respectively and provide hook devices on the elastic cords 81. As shown in at least FIGS. 4 and 9, the free ends of the elastic cords 81 of at least one cord assembly 80 are detachably secured on the first base bar 20 and/or on the second base bar 40 according to what kind of exercise the user may select. There are many ways to achieve detachably securing the elastic cords 81 to the first base bar 20 and the second base bar 40, they will be in the scope of the present invention.

The physical training machine 1 of the present invention can provide user to take the same exercises as aforesaid conventional training machine did. With the cord assembly 80, user further can take various exercises on the physical training machine 1 of the present invention.

Figure 4:
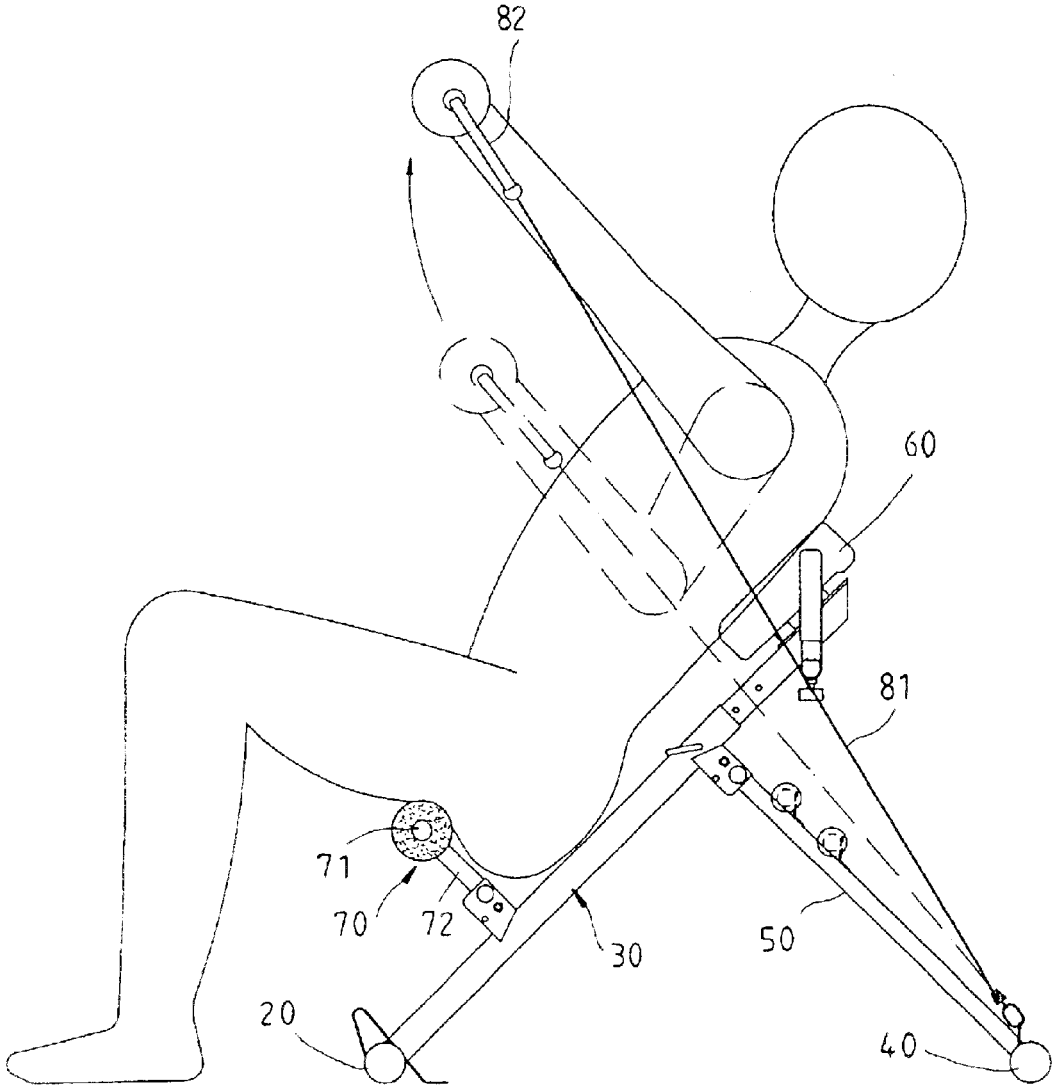
FIG. 4 to FIG. 10 show a user taking exercise on the multifunctional training machine of the prefer embodiment of the present invention in various exercise modes.

Please refer to FIG. 4, user may sit on the second pad member 70 and rest his/her back on the first pad members 60. The elastic cords 81 are installed on the second base bar 40 so that user may hold the holding members 82 to stretch his/her arms forwards or upwards. Thus, user can train shoulder muscles and arm muscles by taking this kind of exercise.

Figure 5:
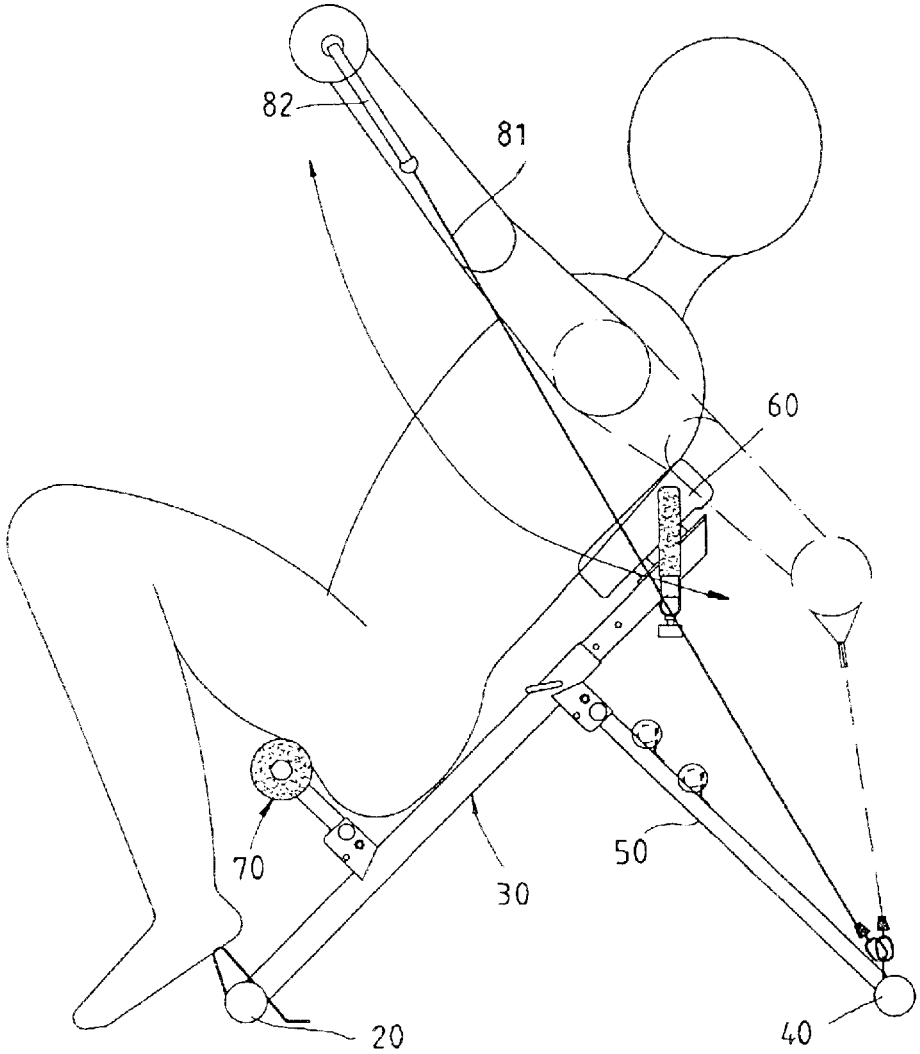

FIG. 5 shows the second exercise mode of the present invention. User may sit on the second pad member 70 and hold the holding members 82 of the cord assembly 80 like aforesaid did, and then extend his/her arms along the lateral sides to adduct the arms forwards or upwards. Thus, user can train arm muscles, pectoral muscles and shoulder muscles.

User also may stand on the ground facing the first frame bar 30 and resting both hands on the first pad member 60 as shown in FIG. 6. He/she rests a foot against the first base bar 20 and the other foot hooking the holding member 82 of the cord assembly 80, such that user can lift the leg backwards to elongate the elastic cord 81 to training leg muscles.

Figure 7:
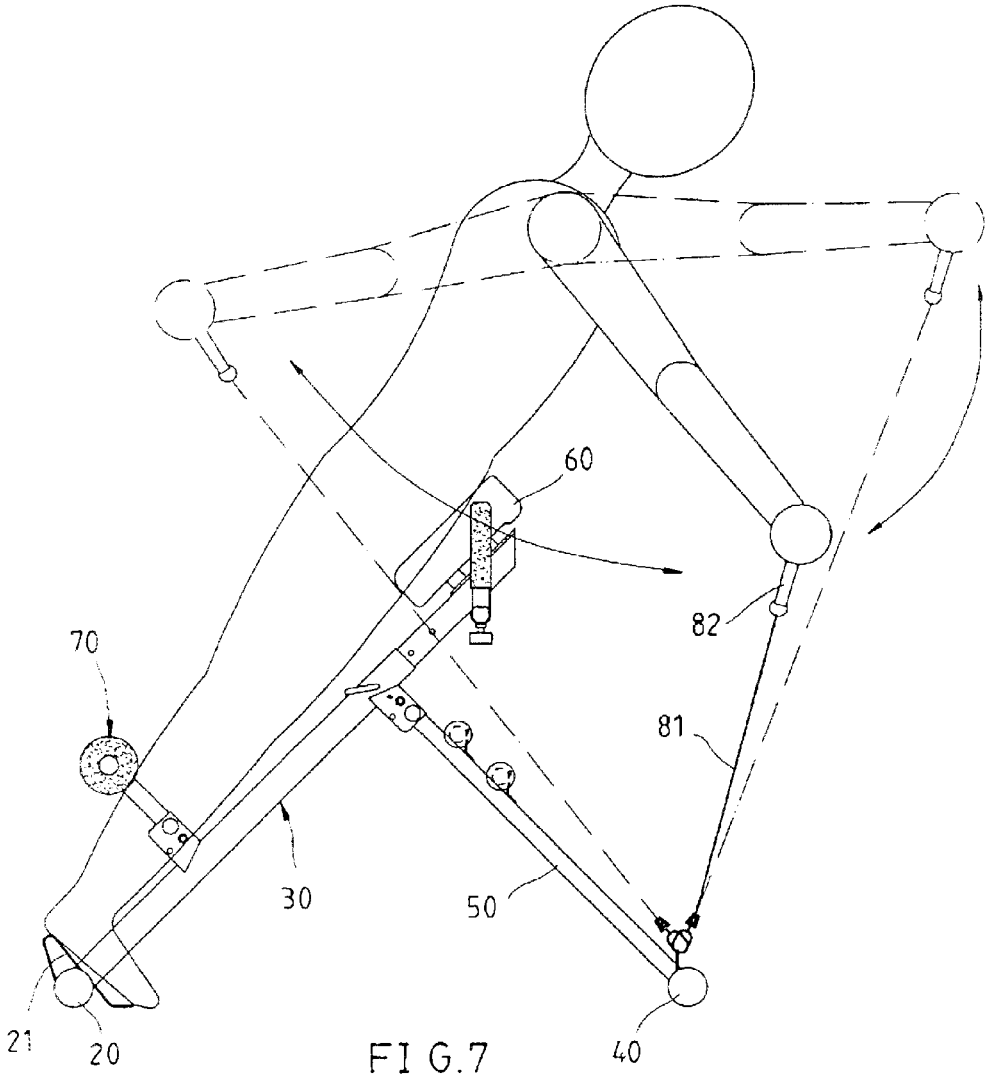

FIG. 7 shows the fourth exercise mode of the present invention. User may stand on the footrest portions 21, rest the abdomen against the first pad members 60 and holds the holding members 82 of the cord assembly 80 by hands. He/she can train arm muscles and shoulder muscles by pulling the elastic cords 81.

Figure 8:
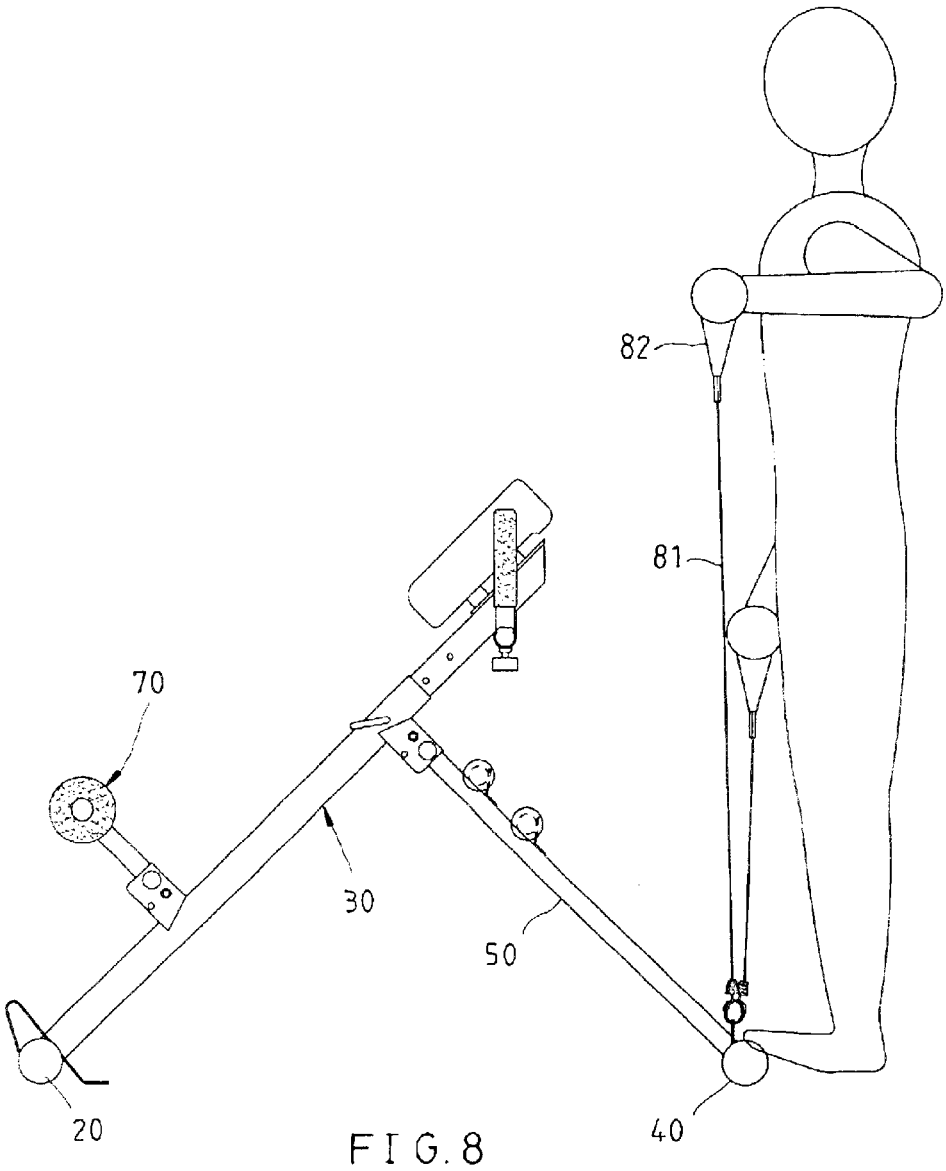

User may just stand on the ground, hold the holding members 82 of the cord assembly 80 by hands and flex the forearms to pull the elastic cords. 81 as shown in FIG. 8.

The elastic cords 81 also can be installed on the first base bar 20 to take the aforesaid exercises. The lengths of the elastic cords 81 can be changed by operating the length adjusting devices 83 to adjust the resistance of the cord assembly 80.

Figure 9:
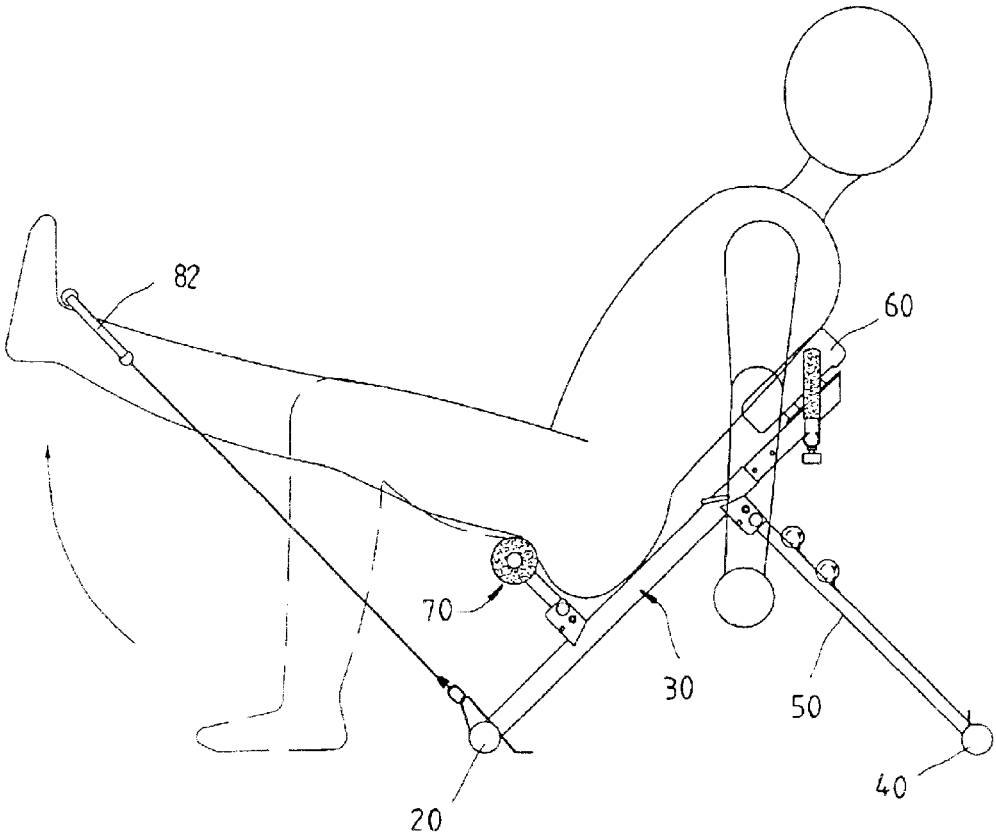

User may sit on the second pad member 70 and lift his/her shanks to pull the elastic cords 81 as shown in FIG. 9. Thus, user may train his/her leg muscles. The cord assembly 80 may have one of the elastic cord 81 installed on the first base bar 20 and have the other one of the elastic cord 81 installed on the second base bar 40.

Figure 10:
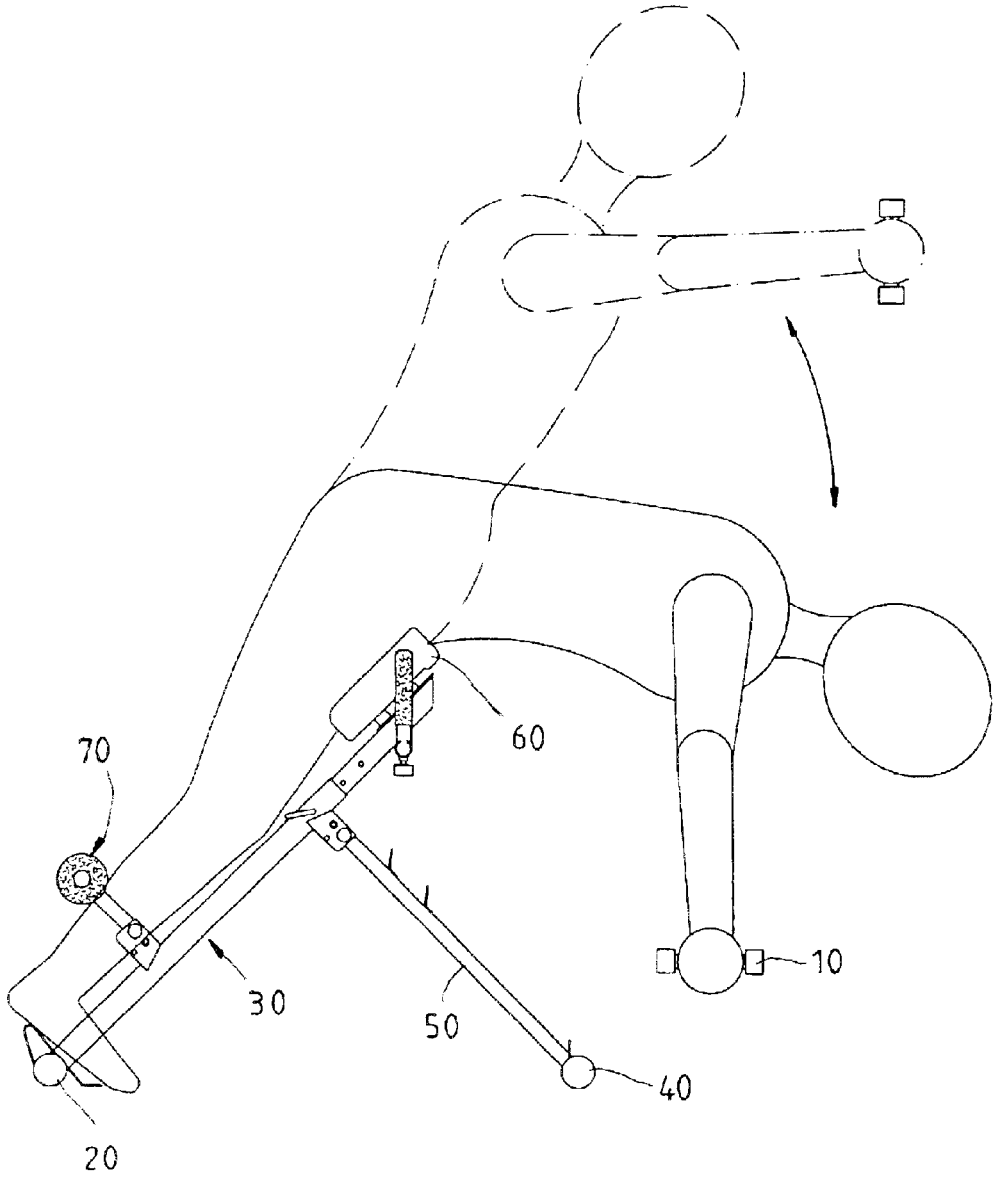

Another exercise mode of the present invention taught in this specification is shown in FIG. 10, which provides user holding the dumbbells 10 and flexing and extending the trunk repeatedly to train back muscles. In addition, user may take the exercises shown in FIG. 4, FIG. 5, FIG. 7 and FIG. 8 by holding the dumbbells 10 to train various muscles.

If user does not want to use the dumbbells 10, he/she can put them on the carrying devices 51 on the second frame bar 50. The dumbbells 10 will not interfere with user to take exercise on the physical training machine 1 of the present invention when put them on the carrying devices 51. They also can be taken easily when user needs them.

In conclusion, the advantages of the present invention are:

1. It provides a variety of exercise modes for user to choose to train various muscles. The cord assembly provides user to train various portions of muscles by taking various exercises on the physical training machine 1 of the present invention. More particularly, it still has a small size to facilitate user to take exercise at home.
2. The dumbbells also play a part of training to provide user having various modes to use the dumbbells.

What is claimed is:

1. A multifunctional physical training machine, comprising:

a frame;

at least one first pad member disposed on said frame adjacent to a top side of the frame;

at least one second pad member disposed on said frame below said first pad member;

at least one cord assembly having two elastic cords and two holding members, wherein said elastic cords have ends respectively connected to a left side and a right side of said frame at a front side or a rear side of the frame and said holding members are disposed at the other ends of said elastic cords respectively; and wherein said frame comprises a first base bar and a second base bar for resting on the ground, a first frame bar having an end thereof fixed with said first base bar and a second frame bar having an end thereof fixed with said second base bar and the other end thereof connected to said first frame bar, wherein said second pad member is disposed on said first frame bar at where it is closest to said first base bar, said first pad member is disposed on said first frame bar where it is closest to the distal end thereof and said elastic cords of said cord assembly are detachably connected to said first base bar or said second base bar.

2. The multifunctional physical training machine as defined in claim 1, wherein said cord assembly further comprises a length adjusting device to change the length of said elastic cord.

3. The multifunctional physical training machine as defined in claim 1, wherein said cord assembly is connected to the front side or the rear side of the frame.

4. The multifunctional physical training machine as defined in claim 1, wherein said second pad member is pivotally mounted on said frame such that the second pad member can be turned outwards from said frame and be turned towards said frame.

5. The multifunctional physical training machine as defined in claim 1, wherein said second frame bar of said frame is provided with a carrying device for receiving a dumbell thereon.

6. The multifunctional physical training machine as defined in claim 1, wherein said first frame bar of said frame is provided with a handle at where it is closest to the distal end thereof.

7. The multifunctional physical training machine as defined in claim 1, wherein said first base bar of said frame is provided with two footrest portions.

8. The multifunctional physical training machine as defined in claim 1, wherein said second frame bar is pivotally connected to said first frame bar for the included angle between said first and said second frame bars can be changed and can be fixed at specific position.

9. The multifunctional physical training machine as defined in claim 1, wherein said first frame bar is a retractable bar assembly.

* * * * *